US005645096A

United States Patent [19]

Hazinski et al.

[11] Patent Number: 5,645,096

[45] Date of Patent: Jul. 8, 1997

[54] NON-SYMMETRICAL LOOP POP UP TENT STRUCTURE AND METHOD

[76] Inventors: Daniel P. Hazinski, 4481 SW. 34th Ter., Ft. Lauderdale, Fla. 33312; Sidney Samole, 6755 SW. 152 St., Miami, Fla. 33157

[21] Appl. No.: 510,050

[22] Filed: Aug. 1, 1995

Related U.S. Application Data

[63] Continuation-in-part of Ser. No. 246,946, May 20, 1994, abandoned, which is a continuation-in-part of Ser. No. 191,370, Feb. 3, 1994, Pat. No. 5,396,917.

[51] Int. Cl.[6] ..... E04H 15/40

[52] U.S. Cl. ..... 135/126; 135/137; 135/905; 135/115; 403/305

[58] Field of Search ..... 135/124, 125, 135/126, 128, 134, 137, 138, 139, 141, 143, 153, 115, 116, 117, 119, 905, 909; 403/305, 314, 291

[56] References Cited

U.S. PATENT DOCUMENTS

| | | | |
|---|---|---|---|
| 557,037 | 3/1896 | Toquet | 403/305 X |
| 1,753,041 | 4/1930 | Bourdon | 403/305 |
| 2,111,799 | 3/1938 | Newpher | 403/305 X |
| 2,125,552 | 8/1938 | Feldhoff | 403/361 |
| 2,244,109 | 6/1941 | Klein | 403/305 X |
| 2,253,435 | 8/1941 | Lang | 403/305 X |
| 3,036,147 | 5/1962 | Wheaton et al. | 403/305 X |
| 3,621,857 | 11/1971 | May et al. | 135/117 X |
| 3,800,814 | 4/1974 | Hibbert | 135/117 X |
| 3,960,161 | 6/1976 | Norman . | |
| 3,990,463 | 11/1976 | Norman | 135/104 |
| 4,709,718 | 12/1987 | Nichols | 135/115 X |
| 4,858,634 | 8/1989 | McLeese . | |
| 4,858,635 | 8/1989 | Eppenbach | 135/117 X |
| 5,014,728 | 5/1991 | Arnold | 135/104 |
| 5,163,461 | 11/1992 | Ivanovich et al. . | |

FOREIGN PATENT DOCUMENTS

| | | | |
|---|---|---|---|
| 250812 | 5/1963 | Australia | 403/305 |

*Primary Examiner*—Lanna Mai
*Attorney, Agent, or Firm*—Richard M. Saccocio, P.A.

[57] ABSTRACT

By the unique usage of non-symmetrical loops, a pop-up tent is configured to have high substantially vertical walls with a floor area only slightly larger than the walled-in area. Thus, a pop-up tent is provided which can be used for both living and sleeping purposes. A method of folding the tent into a flat circular shape for ease of storage and transportation is disclosed and claimed.

15 Claims, 7 Drawing Sheets

NON-SYMMETRICAL LOOP POP UP TENT STRUCTURE AND METHOD

This application is a continuation-in-part of Ser. No. 08/246,946 filed May 20, 1994 now abandoned which was a continuation-in-part of Ser. No. 08/191,370 filed Feb. 3, 1994 now U.S. Pat. No. 5,396,917 issued Mar. 14, 1995.

BACKGROUND OF THE INVENTION

1. Field of the Invention

This invention relates in general to the field of outdoor tents, and in particular to the field of self-erecting tents having an integral frame with attached fabric covering and configured to optimize the interior space thereof.

2. Description of the Prior Art

Fabric covered tents having supporting frame members have been known for many, many years. Such fabric covered tents have been used for various and sundry purposes. One such type of tent is the wigwam tent, historically used by native indians of various countries especially the United States which comprises a conically shaped outer covering attached to a plurality of elongated rods comprising the frame thereof and was used for living purposes. Other such types of tents comprise the field tents used by various armies which have vertical sides and a sloping roof with the frame thereof comprising variously shaped vertical poles. This type of tent was also used for field living as well as for headquarters and operations purposes. These types of tents were typically secured in an erected position by the use of the ropes attached to different points thereof and staked to the ground.

With the advent of more leisure time, prior art tents have began to be used by persons camping out for the sake of camping itself. The evolution of camping tents has progressed relatively quickly over the recent past. The development of camping tents has been toward the use of lighter materials, tents which are quickly erected, and tents which fold for easy storage and transportation. Some examples of camping tents utilize an exterior or interior frame using interlocking aluminum poles to which the tent fabric is attached by straps. Camping tents have taken on many configurations including an igloo or rounded shape, a square or rectangular shape or even a conical shape. However, prior art camping tents still utilize separate frames and fabric coverings which are required to be attached to each other at the camping site.

In the very recent past, a new type of tent generally referred to as a pop-up tent has come into being. The pop-up tent comprises a tent which is folded into a relatively small package of minimal size using lightweight materials which allows for easy transport. The unique feature of the pop-up tent is that when they are removed from their fabric container and thrown up into the air, the springiness of the integral frame triggers a self erecting action which stretches the tent fabric into the tent's final configuration and by the time the tent reaches the ground, the tent is fully formed. Then, all that remains is for the tent to be located in a desired location and staked to the ground for immediate use. Typically, the pop-up tents fold into a storage configuration, almost as easily as they are erected and thus, are folded in a very brief period of time.

The first generation of the pop-up tents utilized a plurality of wire loops with each loop being a separate component and fitting within a sewn in sleeve in the tent fabric at an appropriate location. A more recent generation of pop-up tents comprises a single wire frame which is again attached to the tent fabric within sewn-in sleeves with the single wire frame forming two loops. One loop comprising the loop which fits flat against the ground when the tent is erected. The second loop having a saddle like configuration above the ground loop and thereby forming the wall and roof structure of the tent with both loops being the same length and symmetrical. Because of the convenience and self erecting nature of the pop-up tents, the same has enjoyed quick acceptance among the camping public. Indeed, such tents have also been used for hunting purposes as well as cabana purposes providing shade on the beach or in the field.

A major disadvantage of the prior art pop-up tents is the ability to optimally use the interior space. For example, the prior art pop-up tents typically have a large base area with a relatively low and sloping side wall and roof configuration. While this configuration is very adaptable to a person's sleeping position, that is lying pronate, it has the disadvantages of not allowing a person to stand up in the tent and thereby "live" in the tent. Thus, the usefulness of the prior art pop-up tents is relatively limited to sleeping purposes.

Accordingly, it is a primary object of the present invention to provide a self erecting, pop-up tent which is capable of being used for both living and sleeping purposes with the use of non-concentric loops.

Another object of the present invention is to provide a self erecting, pop-up tent which allows persons using the tent to stand up therein in a fully erect position and even walk about the tent.

Another object of the present invention is to provide a self erecting, pop-up tent having substantially vertical walls extending from the base thereof.

Another object of the present invention is to provide a self erecting, pop-up tent having two non-symmetrical loops made from a single or multi-filament wire or rod which is foldable into a compact flat circular storage and transportation configuration.

Another object of the present invention is to provide a self erecting, pop-up tent having a minimal ground area loop relative to the total volume of the tent.

SUMMARY OF THE INVENTION

The above objects as well as others are achieved by the present invention in accordance with a fair reading and interpretation of this specification including all parts and subparts hereof and further including the drawings, claims and abstract.

A single rod or multi-rod frame or supporting structure is arranged with single or multi-connector, respectively, and together with an attached fabric structure forms a self erecting pop-up tent. In the erected configuration, a first ground loop is formed in a single horizontal plane with a second loop, comprising the walls and roof of the tent, being formed above the ground loop. The two loops are not symmetrical. The roof and wall loop is larger than the base or ground loop. Notwithstanding the non-symmetrical configuration of the loops, the pop-up tent maintains the self-erecting nature of such tents and most importantly the foldability of such tents is similarly maintained. The unique method of folding the tent is more fully described hereinafter. By varying the degree of non-symmetry between the two loops, the inventive tent assumes an infinite number of different ratios of ground area to vertical height and contained volume of the tent. Hence, one configuration obtainable by the inventive tent is a pop-up tent having substantially vertical walls extending upward from the ground loop. Other intermediate configurations are obtainable having varying degrees of wall slopes relative to the ground loop. The single wire or multi-wire or rods forming the tent structural frame is joined together by a single connector or multi-connectors which in one embodiment is independently and swivably connected to each end of the single rod or rods. The connector provides for freedom of rotation of each end of the single rod or rods during the erecting and folding of the tent. The connectors includes a central transverse wall portion having opposed sides each of which respectively limits the insertion of the free ends of the rod and yet allows for relative rotation of the ends of the rods with the connector itself or connectors themselves. The inherent spring characteristics of the wire or rod frame of the tent maintains the positioning of the rod ends within the axial opening of the coupler on each side of the wall therebetween. The inventive pop-up tent which uses non-concentric loops may use a double ended multi-swivel connectors, or it may use a swaged at one end connector or connectors.

The inventive non-symmetrical pop-up tent may be provided with an additional pop-up portion at the roof portion thereof such that additional internal height may be achieved.

The inventive pop-up tent may be further provided with a rainfly which is adapted to be fitted to sleeves which are formed in the tent fabric substantially parallel to the sleeve of the upper loop.

The pop-up center portion as well as the rainfly in accordance with the invention folds into a compact circle when the underlying inventive tent structure itself is folded into a compact circle configuration.

The inventive tent may also be provided with a plurality of elongated openings in the tent walls and roof so that the same may be used as a hunting blind structure.

BRIEF DESCRIPTION OF THE DRAWINGS

Various other objects, advantages and features of the invention will become apparent to those skilled in the art from the following discussion taken in conjunction with the following drawings, in which:

FIGS. 9A–12illustrate a method of folding the inventive non-symmetrical loop pop-up tent into a folded flat and round configuration.

DETAILED DESCRIPTION OF THE PREFERRED EMBODIMENTS

Figure 1:
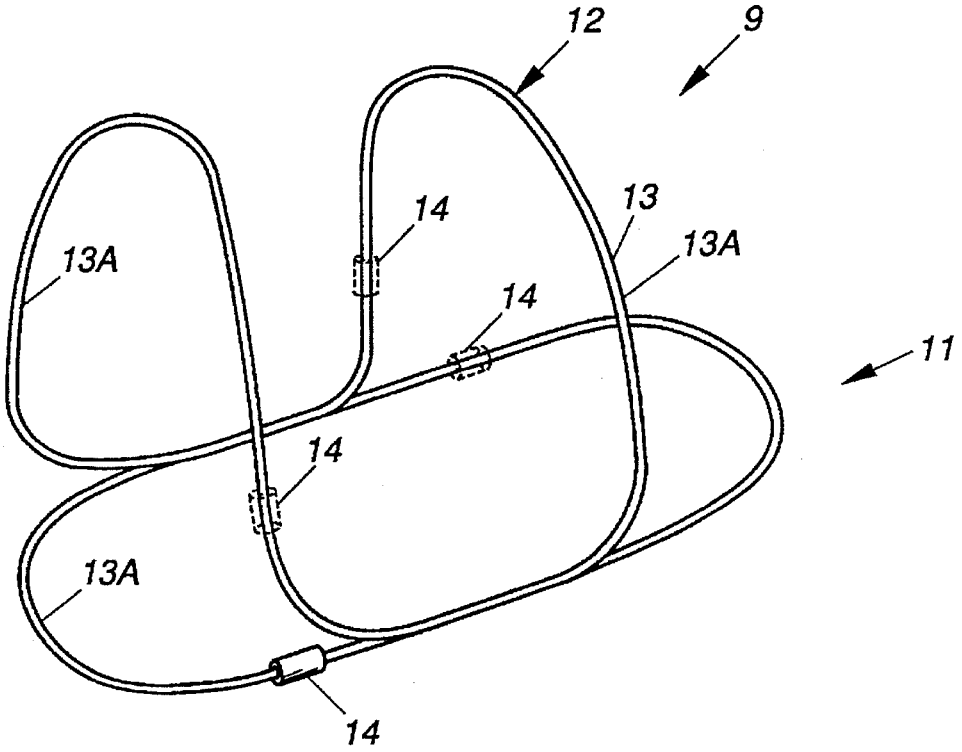
FIG. 1 is an isometric view of the frame of the inventive pop-up tent.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the various figures of the drawings, wherein like characteristics and features of the present invention shown on the various figures are designated by the same reference numerals.

FIG. 1 shows, in perspective, the rod or wire frame 9 of the pop-up tent 10 (FIG. 3) illustrating the ground loop 11, and the wall and roof loop 12, both being formed from a single rod 13, the ends of which are attached by a single connector 14. The circumferencial length of the ground loop 11 is not the same as the circumferencial length of the wall and roof loop 12. The circumferencial of the wall and roof loop 12 is the larger of the two. The single rod 13 is preferentially made from an appropriate material having spring like characteristics such as fiberglass or the like. Although, not preferred, rod 13 may alternatively be made from a material such as metal. Alternatively, the rod frame 9 or supporting structure of the tent 10 may be made from a plurality of rods 13A connected together by additional connector members shown in phanthom in FIG. 1. For purposes of this description, the ground loop 11 is sometimes referred to as the base loop while the wall and roof loop 12 is sometimes referred to as the transverse loop. Thus, the ground loop 11 is intended to lie flat against the ground when the tent is fully erected. The transverse loop 12 forms the height structure which provides the tent 10 with the vertical height of the walls as well as the shape of the roof.

Figure 2:
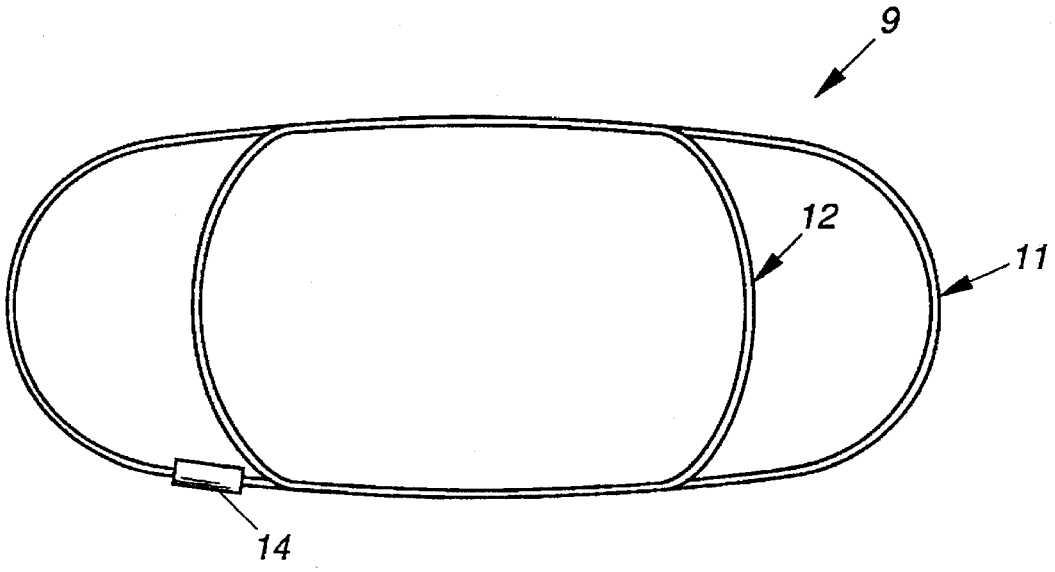
FIG. 2 is a top plan view of the frame of FIG. 1.

FIG. 2 shows an upper plan view of the tent frame 9 of FIG. 1. In this figure, it is clearly seen that the projective area of the transverse loop 12 is not much smaller than that of the ground loop 11. In this manner, the area encompassed by the ground loop 11, which comprises the floor area of the tent 10, is only slightly larger than the projected area of the transverse loop 12. Thus, the pop-up tent frame 9 of FIGS. 1 and 2 presents a tent 10 having a configuration with substantially vertical side walls. Such substantially vertical side walls therefore provide the tent with a far greater amount of interior usable space or alternatively stand-up space as compared to prior art pop-up tents.

Figure 3:
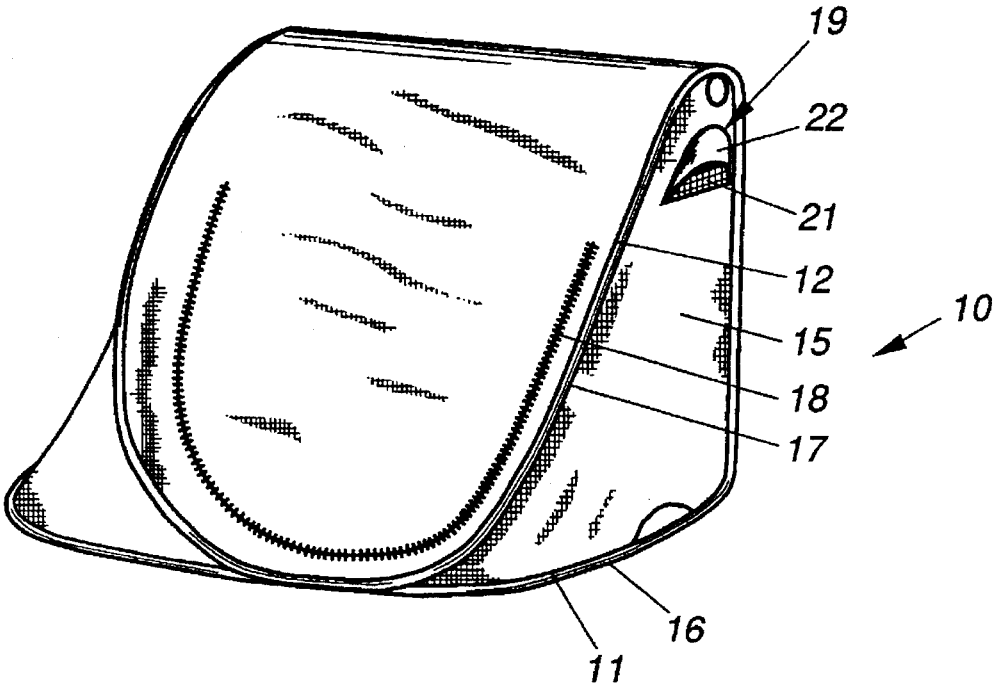
FIG. 3 is an isometric view of an erected pop-up tent according to the present invention showing the fabric attached to the frame thereof.

Tent 10 in FIG. 3 depicts in isometric form the frame members of FIGS. 1 and 2 with tent fabric 15 attached thereto. Fabric 15 may comprise any previously known material from which tents are constructed. However, it is preferable that a lightweight nylon reinforced plastic fabric be utilized. Such fabric is substantially impervious to the elements and is tear resistant. Additionally, such fabric may be conventionally sewn so that reinforcing pads and zippers or the like may be readily attached thereto. The tent floor, the tent walls, and the tent roof are provided with sewn in sleeves at their junction which coincides with the looped configurations of rod 13 as shown in FIG. 1 of the drawings when the tent is erected. Sleeve 16 in conjunction with the springiness of rod 13 thusly provides for the configuration of the base loop 11 comprising the tent floor. The portion of rod 13 forming the base loop 11 of course fitting within the sleeve 16. Similarly, the sleeve 17 and the springiness of rod 13 provides for the configuration of the transverse loop 12 with the portion of rod 13 forming the transverse loop 12 fitting within sleeve 17. It is to be noted that connector 14 also fits within sleeve 16 of base loop 11.

One or more openings 18 may be provided in the tent fabric 15 at the ends of base loop 11 for purposes of staking the rod 13, and therefore the base loop 11 to the ground so that tent 10 when fully erected is maintained in a flat position on the ground. A zippered opening 19 may be provided in the front portion of the tent 10 to gain ingress to and egress from the tent itself. One or more covered window openings may also be provided in the tent fabric 15 at various advantageous locations which may include screening 21 covered by a pop-out covering 22.

Figure 4:
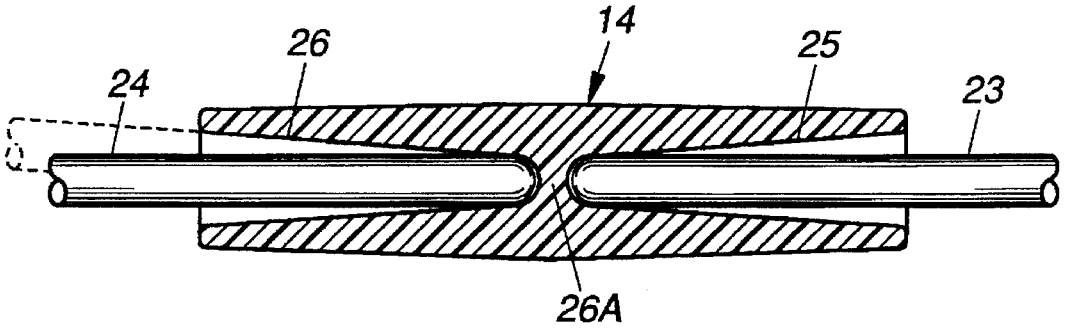
FIG. 4 is a cross-sectional view, in an enlarged scale, of a swivel connector used to attach the ends of the rod forming the frame of the inventive pop-up tent.

FIG. 4 illustrates a large scale rendering of the connector 14 which is utilized to join the adjoining ends 23 and 24 of rod 13. The connector 14 comprises a unitary body having a substantially cylindrical shape. While shown as having a tapered shape, the outer configuration of connector 14 is relatively immaterial. A pair of co-axial holes 25 and 26 extend from the ends of connector 14 axially therewithin ending at a wall portion 26. Blind holes 25 and 26 are seen to be convergingly tapered toward wall portion 26. Wall portion 26 provides a stop for each end of rod 13 which prevents the physical ends of end portions 23 and 24 from coming into contact with each other. The rounded end portions of rod ends 23 and 24 as well as the rounded configuration of wall portion 26 allows for non frictional rotation of rod ends 23 and 24 or connector 14 relative to each other. The anti-frictional rotational motion between rods ends 23 and 24 and connector 14 is preferred to prevent binding of the rod 13 when the tent 10 is either popped up into its final configuration or folded flat for storage. When either of these actions occur, a certain amount of rotation of rod 13 occurs which if not provided for would cause binding of the ends of the rod 13. The rounded configuration of the ends of rod 13 as well as the rounded configuration of wall 26 as explained eliminates this possibility of frictional binding. The taper of blind holes 25 and 26 may be between the range of 1 to 5 degrees each. This slight amount of taper allows for further frictionless relative rotation of rod ends 23 and 24 or connector 14 relative to each other due to the tendency of rod 13 to assume an arcuate configuration because of its springiness. The combined spring force of rod 13 and the configuration it assumes because of the constraining configuration of sleeves 16 and 17, negates any tendency for rod ends 23 and 24 to slip out of connector 14. Rather the reverse is true and thus there is the need for the mating rounded end configurations previously described.

Figure 4A:
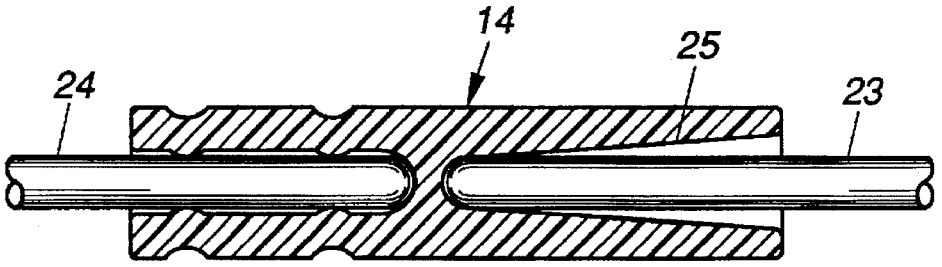
FIG. 4A is a cross-sectional view, in an enlarged scale, of a single end swaged connector.

FIG. 4A depicts an alternative embodiment of connector 14A wherein one end is firmly connected to one rod end. The connection may comprise a swagged connection or other mechanical connection or even a glued connection.

Figure 5:
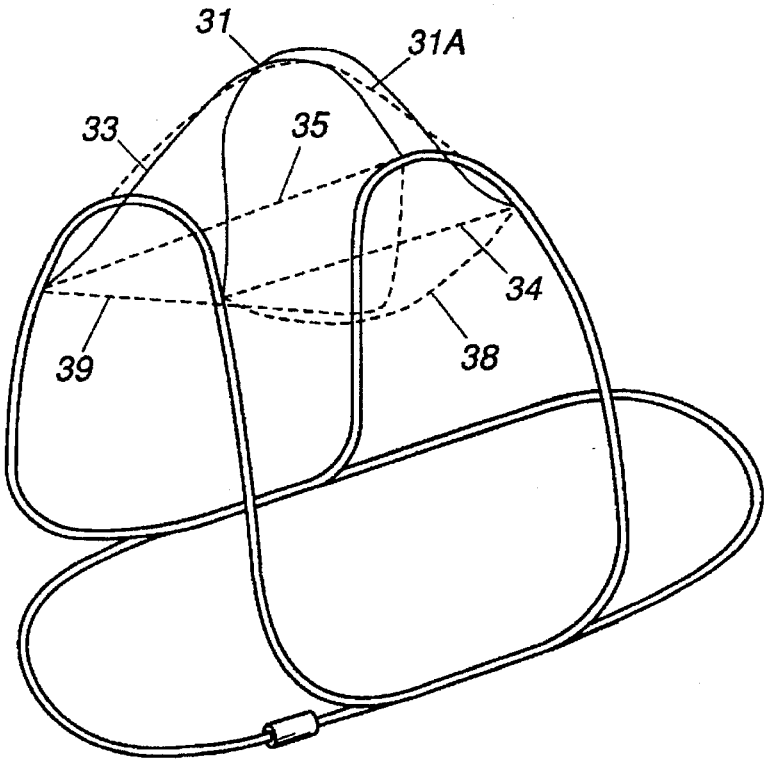
FIG. 5 is a isometric view of the frame of FIG. 1 including a central pop-up portion attached to the upper loop of the inventive tent.

FIG. 5 depicts the frame of FIG. 1 together with a pop-up center portion 31 which may be utilized to provide additional height to the inventive tent structure 10. The pop-up tent center portion 31 preferable comprises a pair of rods 32 and 33 with rod 32 extending between opposite sides of the transverse loop 12 along a first front horizontal line and, the second wire rod 33 extending between opposite sides of the transverse loop 12 along a second back horizontal line (for convenience shown by the imaginary dash lines 34 and 35, respectively) the imaginary lines 34 and 35 are spread apart from each other, but lie in the same imaginary horizontal plane. Rods 32 and 33 are angled toward each other in an upward direction and meet at the approximate geometric center of the transverse loop 12. The upperwardly curved shape of rods 32 and 33 is effectuated when the rods are fitted to the tent fabric 15 and when the tent 10 is erected. Rods 32 and 33 being fitted within sleeves 36 and 37 provided in the tent fabric 15.

An alternative embodiment of the pop-up center portion utilizes a single rod extending from the middle of the one side of transverse loop 12 to the middle of the other side of transverse loop 12 as shown by dashed line 31A. Single rod 31A would also fit within a sleeve sewn into tent fabric 15.

Figure 6:
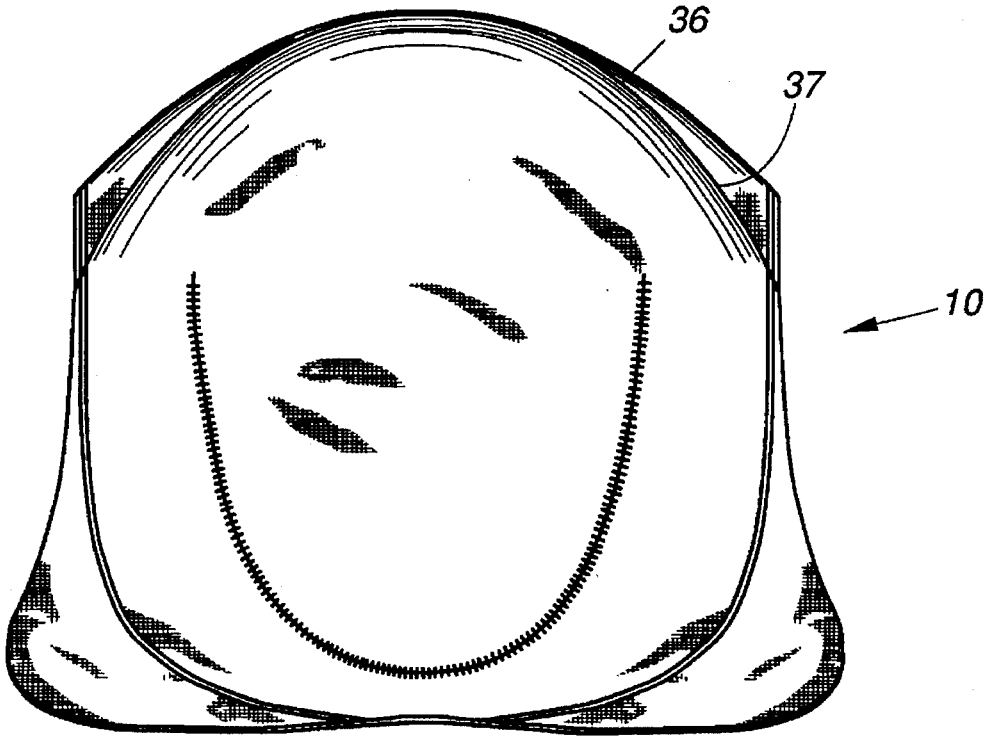
FIG. 6 is a side view of the frame structure of FIG. 5 showing the tent fabric attached thereto.

FIG. 6 depicts the tent of FIG. 3 being provided with the pop-up center portion 31 with the tent fabric in place and the tent being erected. The added stand up height provided by the framework of FIG. 5 is clearly seen in FIG. 6. The pop-up center portion 31, in FIG. 5 may be popped down to the configuration shown by dashed lines 38 and 39. The spring tension in rods 32 and 33 provide for the popped up or down configuration of center portion 31. The end points of rods 32 and 33 need not be physically attached to the transverse loop 12. The sewn in sleeves 36 and 37 at their respective junction with sleeve 17 provides for sufficient entrapment of the ends of rods 32 and 33 and sufficient flexibility so as not to require a pivot attachment at these locations.

Figure 7:
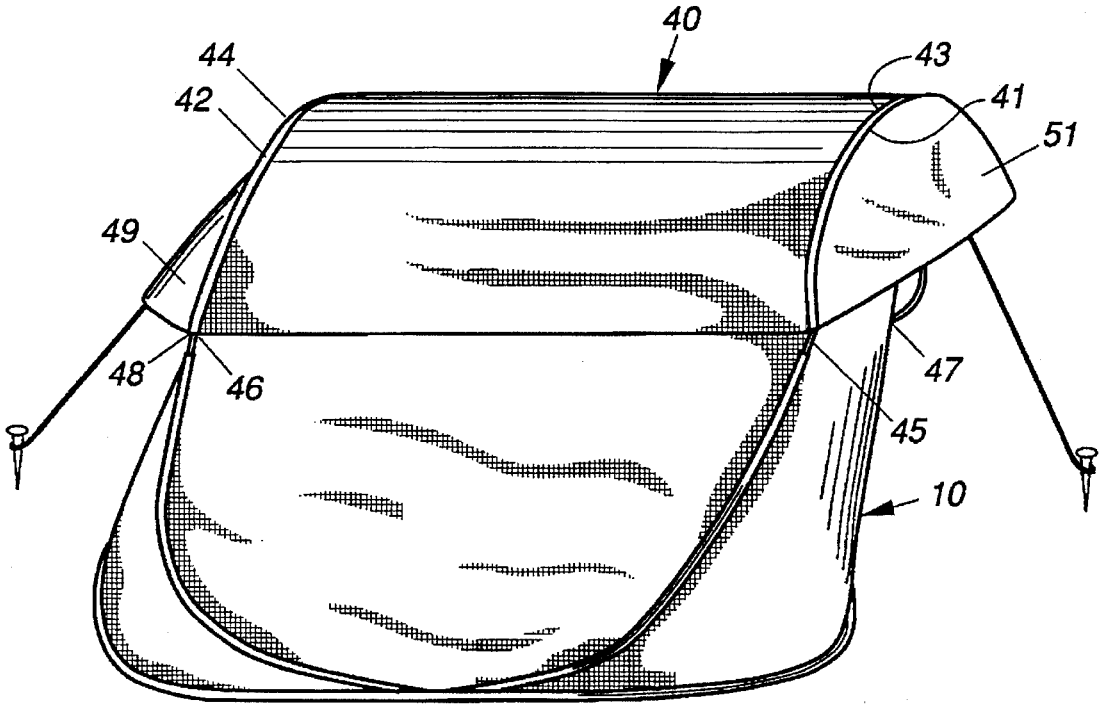
FIG. 7 is an isometric view of the tent of FIG. 3, illustrating the attachment of a rain fly thereto.

FIG. 7 shows a rain or sun fly 40 (sometimes referred to as tent fly 40) adapted to be fitted to the inventive tent 10. The purpose of a rain or sun fly is to further protect the interior space of a tent from the elements such as rain or sun. Hence a desirable feature of such rain or sun fly is to maintain the same in a spaced relationship above the tent fabric. In this manner, the rain or sun fly receives the brunt of the elements and due to the spaced relationship between it and the tent with the air therebetween serving as a insulating barrier, the tent is further protected from the elements. Accordingly, it is desirable that the rain or sun fly be maintained in a spaced apart relationship from the tent proper and that it be structurally stable so as to not be effected by strong wind and hard rain. This may be accomplished utilizing a removable fly or a fly sewn to the tent fabric over breathable vents.

In accomplishing its desired purposes, the inventive sun and rain fly 40 is provided with rod frame members 41 and 42 which fit within sleeves 43 and 44 which may be sewn within the sun or tent fly. The combination of the sleeve configuration and the springiness of the rods 41 and 42 provide the tent fly 40 with a partial cylindrical shape. The end portions of each rod 41 and 42 fit within respective sleeve openings 45 and 46 in the front of the tent and sleeve openings 47 and 48 at the back of the tent. Sleeve openings 45 through 48 provide a four points of support for the tent fly 40. As shown in FIG. 7, the four support points lie along the line of the sleeve 17 of the transverse loop 12. The springiness of rods 41 and 42 in conjunction with the confinement provided by sleeves 45 through 48 firmly attaches tent fly 40 to tent 10.

A pair of side flaps 49 and 51 may be provided at each side end of tent fly 40 which function as additional rain and sun blocks. Rope means 52 attached to respective edges of flaps 49 and 51 may be staked to the ground to provide additional stability to tent fly 40. Tent fly 40 may be provided with a zippered or velcroed opening at the front entrance of the tent so that the tent fly 40 will not interfere with ingress or egress from the tent 10.

Figure 8:
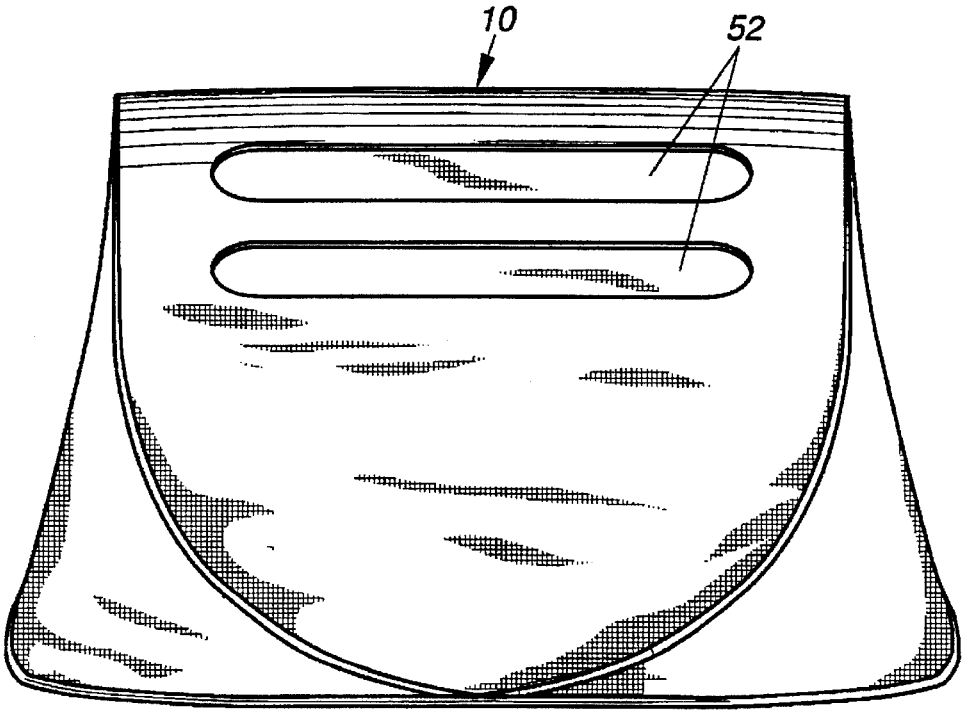
FIG. 8 is a front plan view of the inventive tent provided with one or more elongated openings in the wall and roof thereof.
Figure 9A:
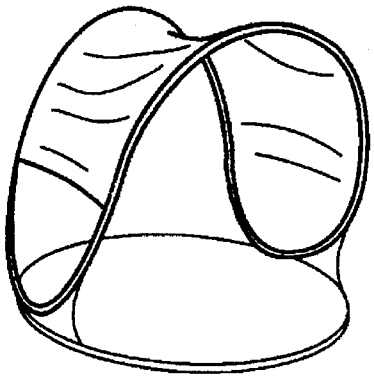
Figure 9B:
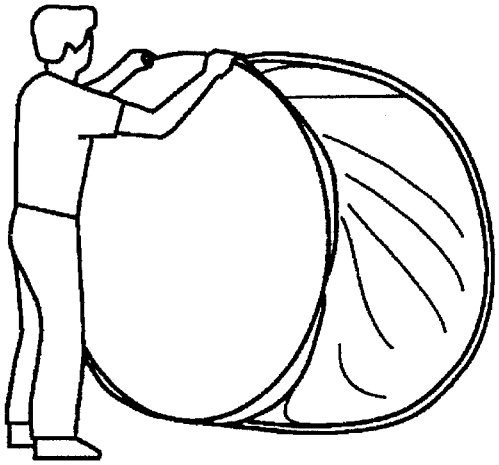
Figure 9C:
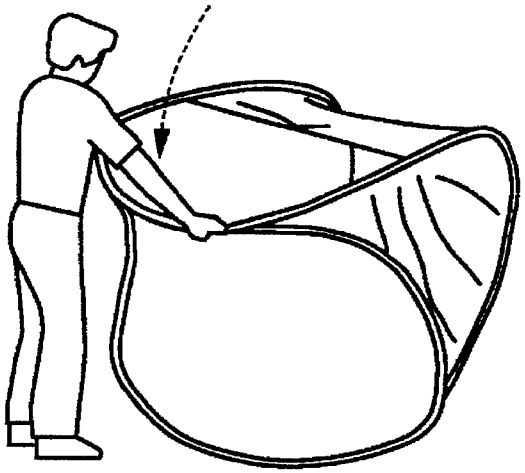
Figure 9D:
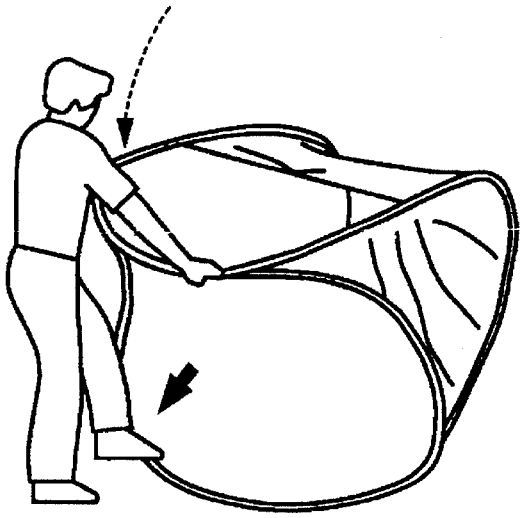
Figure 9E:
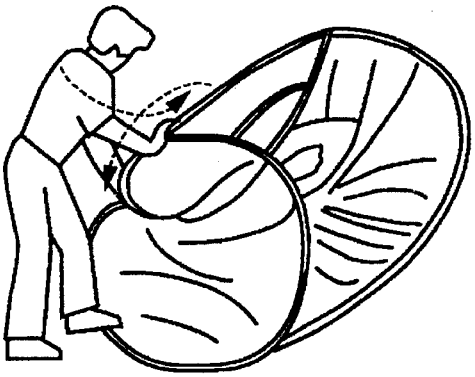
Figure 9F:
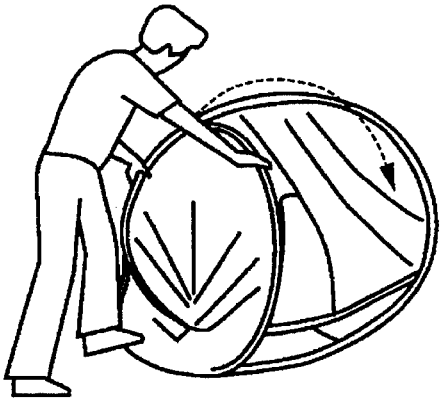
Figure 9G:
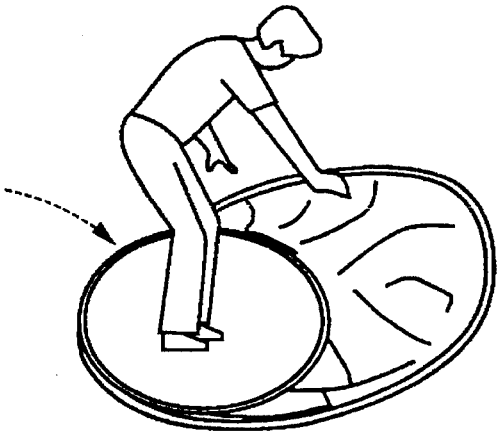
Figure 9H:
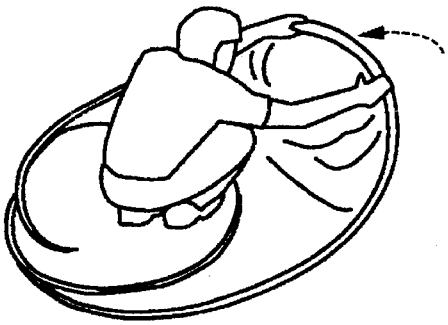
Figure 9I:
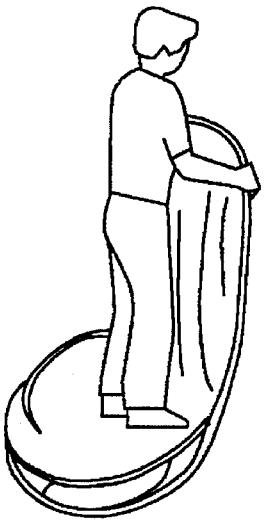

FIG. 8 illustrates an embodiment of the non-symmetrical loop tent 10 wherein one or more elongated opening 51 are provided in the walls and the roof of the tent 10. Openings 51 provide a person within the tent with an unobstructed view of outside surroundings and are sufficiently long to allow the use of a hunting rifle from within the tent 10. The embodiment of FIG. 8 can also be widely used by a photographer or a bird watcher or the like.

The non-symmetrical loops of the tent 10 is capable of being folded flat for storage and transportation. FIG. 9 depicts the method of folding the tent 10 in sequentially illustrated steps. The tent 10 is to be initially prepared for folding by removing the tent fly 40, if attached, and removing any stakes anchoring the tent 10 to the ground. If the tent 10 is equipped with the pop-up center portion 31, the same is to be folded down as per FIG. 5. Next, the ingress and egress opening is unzippered (9-1).

The folding sequence begins by flipping the tent 10 over on its side exposing the bottom of the ground loop and tent floor such that the same faces the person. Using both hands, the person grasps the top portion of both the transverse loop and the ground loop, one part in each hand, as shown in FIG. 9-2. The person then places his left foot on the bottom portion of the ground loop and the transverse loop and begins pushing down with his left hand as per FIGS. 9-3 and 9-4. With his left hand still pushing down, he begins to buckle the ground and transverse loops with his left hand while twisting his right hand toward the left hand, FIG. 9-5. At this time the ground loop begins to form into two circular rings.

The upper ring is then pushed forward toward the person and downward toward the ground as shown in FIG. 9-6. When the upper ring is fully collapsed onto the lower ring, the person steps forward onto the two formed rings (FIG. 9-7). At this time another larger ring comprising part of the transverse loop is formed under the two smaller rings (FIG. 9-7). While still standing on the two smaller rings the person grasps the larger ring with both hands which is then pulled upward and toward the person (FIGS. 9-8 and 9-9).

Figure 10A:
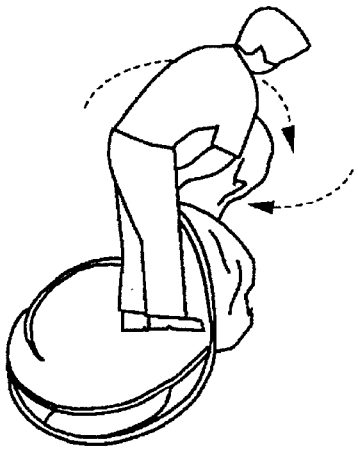
Figure 10B:
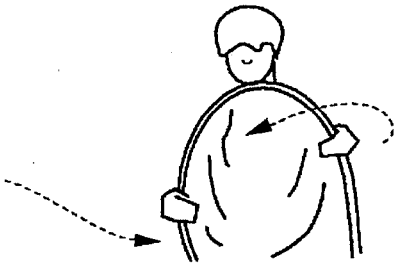
Figure 10C:
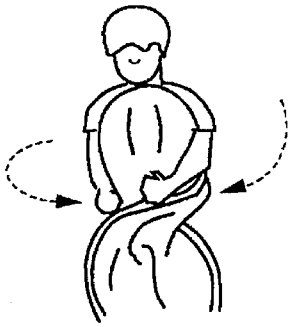
Figure 11:
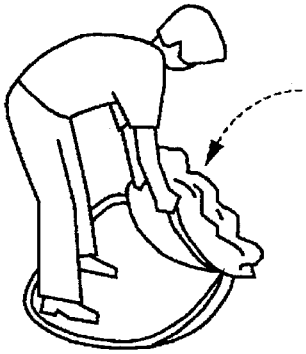
Figure 12:
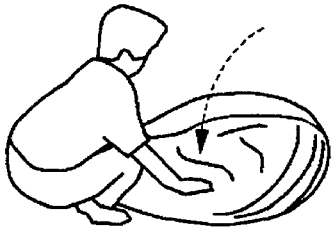

The larger ring is twisted by using the right hand to pull the ring toward the person and to his left. At the same time the left hand is used to twist the ring forward and over the right hand as shown in FIGS. 9-10A, 9-10B, and 9-10C. This maneuver causes the larger ring to be formed also into two smaller rings. These two smaller rings are then both folded over the two rings the person is standing on (FIG. 9-11). The result is four small rings each successively on top of another. Finally, all rings are combined into concentric rings which allows a strap or elastic band to be placed across a common diameter of all the rings (FIG. 9-12). The folding is now complete.

Thus, there is effectuated, by the method disclosed, folding of a non-symmetrical loop pop-up tent into a flat circular configuration for purposes of storage or transportation.

While the invention has been described, disclosed, illustrated and shown in certain terms or certain embodiments or modifications which it has assumed in practice, the scope of the invention is not intended to be limited thereby and other modifications or embodiments as may be suggested by the teachings herein are particularly reserved as they fall within the scope of the breadth and scope of the claims herein appended.

We claim:

1. Pop-up tent apparatus comprising a frame comprising at least one elastic rod formed into a first ground loop and a second transverse side wall and roof loop, said first and second loops being non-symmetrical with the second loop being larger in circumferential length than the first loop, at least one connector means joining together ends of said single rod or multiple rods, fabric covering configured to fit over said first and second loops, said first and second loops fitting within sleeve means provided with said fabric covering said sleeve means being configured to coincide with the configuration of said first and second loops.

2. The pop-up tent apparatus of claim 1 wherein said at least one elastic rod comprises a pultruded glass rod.

3. The pop-up tent apparatus of claim 1 wherein said sleeve means comprises an elongated tubular member having an opening therethrough and attached to said fabric covering.

4. The pop-up tent apparatus of claim 3 wherein said tubular member forms part of said fabric covering.

5. The pop-up tent apparatus of claim 1 wherein said at least one connector means comprises a cylindrical member having an opening emanating from each end thereof, extending axially inward, and terminating at a wall portion therebetween.

6. The pop-up tent apparatus of claim 5 wherein each of said openings is convergingly tapered toward the wall portion.

7. The pop-up tent apparatus of claim 6 wherein each side of said wall portion is concavely configured and each end of said single rod is convexly configured.

8. The pop-up tent apparatus of claim 1 including a height increasing pop-up center portion comprising second elastic rod means and second sleeve means, said second rod and sleeve means emanating from a first side of said second loop and a second opposite side of said second loop of said second loop and reaching an apex at an approximate geometric center of said tent.

9. The pop-up tent apparatus of claim 8 including third elastic rod and sleeve means emanating from opposite sides of said second loop and reaching an apex at an approximate geometric center of said tent, said second rod and sleeve means being attached to a front portion of said transverse loop and said third rod and sleeve means being attached to a back portion of said transverse loop.

10. The pop-up tent apparatus of claim 1 including a tent fly removably attached to said pop-up tent apparatus.

11. The pop-up tent apparatus of claim 10 wherein said tent fly comprises a covering having second and third elastic rod and sleeve means, said second elastic rod and sleeve means being removably attached to the front and back of one side of said transverse loop, the third elastic rod and sleeve means being removably attached to the front and back of the other side of said transverse loop.

12. The pop-up tent apparatus of claim 11 wherein each end of said second and third elastic rod means fits within the sleeve opening in said fabric covering housing said transverse loop.

13. The pop-up tent apparatus of claim 10 wherein said tent fly is fixedly attached to said tent fabric above breathable vents in said tent fabric.

14. The tent apparatus of claim 1 including viewing means provided in the tent wall for substantially unobstructed viewing of surroundings outside of the tent.

15. The tent apparatus of claim 14 wherein said viewing means comprises one or more elongated openings in said tent wall.

* * * * *